US007812800B2

(12) United States Patent
Peng et al.

(10) Patent No.: US 7,812,800 B2
(45) Date of Patent: Oct. 12, 2010

(54) DESIGN APPROACH AND PANEL AND ELECTRONIC DEVICE UTILIZING THE SAME

(75) Inventors: Du-Zen Peng, Jhubei (TW); Po-Yen Lu, Longtan Township (TW); Yaw-Ming Tsai, Wurih Township (TW); I-Wei Wu, Hsinchu (TW)

(73) Assignee: TPO Displays Corp., Chu-Nan (TW)

( * ) Notice: Subject to any disclaimer, the term of this patent is extended or adjusted under 35 U.S.C. 154(b) by 1418 days.

(21) Appl. No.: 11/232,478

(22) Filed: Sep. 21, 2005

(65) Prior Publication Data

US 2006/0061527 A1 Mar. 23, 2006

Related U.S. Application Data

(60) Provisional application No. 60/612,103, filed on Sep. 22, 2004.

(51) Int. Cl.
*G09G 3/32* (2006.01)

(52) U.S. Cl. ..... 345/83; 345/82

(58) Field of Classification Search ..... 345/55, 345/76, 77–81, 82, 83, 205, 206, 207, 690
See application file for complete search history.

(56) References Cited

U.S. PATENT DOCUMENTS 4,329,625 A 5/1982 Nishizawa et al.
5,683,823 A * 11/1997 Shi et al. ..... 428/690
5,707,745 A * 1/1998 Forrest et al. ..... 428/432
6,069,676 A * 5/2000 Yuyama ..... 349/62
6,489,631 B2 * 12/2002 Young et al. ..... 257/59
6,542,138 B1 4/2003 Shannon et al.
6,720,942 B2 4/2004 Lee et al.
6,738,031 B2 * 5/2004 Young et al. ..... 345/55
6,801,000 B2 * 10/2004 Jongman et al. ..... 315/169.1
7,038,240 B2 * 5/2006 Matsumoto ..... 257/59
7,161,566 B2 * 1/2007 Cok et al. ..... 345/76

(Continued)

FOREIGN PATENT DOCUMENTS

CN 1450509 10/2003

(Continued)

OTHER PUBLICATIONS

Mameno, K., "High Performance & Low-Power AMOLED Using White Emitter with Color-Filter Array", IDW '04, pp. 259-262, AMD2/OLED4-1.

(Continued)

*Primary Examiner*—Amare Mengistu
*Assistant Examiner*—Dmitriy Bolotin
(74) *Attorney, Agent, or Firm*—Liu & Liu

(57) ABSTRACT

A design approach for a panel including a luminiferous unit and a driving unit. The luminiferous unit comprises first and second color components respectively constituting first and second light component sources. First and second light components are emitted from the first and the second light component sources. The color of the first light component differs from that of the second light component. The design approach comprises defining a specific relationship according to a characteristic between the first and the second color components; and designing the driving unit according to the specific relationship.

17 Claims, 9 Drawing Sheets

U.S. PATENT DOCUMENTS

| | | | | |
|---|---|---|---|---|
| 7,221,337 | B1 * | 5/2007 | Choi et al. | 345/76 |
| 7,242,145 | B2 * | 7/2007 | Young | 315/169.3 |
| 7,262,753 | B2 * | 8/2007 | Tanghe et al. | 345/82 |
| 7,295,192 | B2 * | 11/2007 | Hu | 345/176 |
| 7,321,348 | B2 * | 1/2008 | Cok et al. | 345/82 |
| 7,453,424 | B2 * | 11/2008 | Johnson et al. | 345/76 |
| 2001/0052597 | A1 * | 12/2001 | Young et al. | 257/59 |
| 2004/0021423 | A1 * | 2/2004 | Jongman et al. | 315/169.1 |
| 2004/0041525 | A1 * | 3/2004 | Park et al. | 315/169.3 |
| 2005/0001147 | A1 | 1/2005 | Tanada | |
| 2005/0110420 | A1 | 5/2005 | Arnold et al. | |
| 2005/0117190 | A1 | 6/2005 | Iwauchi et al. | |
| 2005/0168419 | A1 * | 8/2005 | Shimizu | 345/82 |
| 2005/0200578 | A1 | 9/2005 | Lee et al. | |
| 2005/0248513 | A1 * | 11/2005 | Hu | 345/76 |
| 2005/0248516 | A1 * | 11/2005 | Li | 345/82 |
| 2006/0038758 | A1 * | 2/2006 | Routley et al. | 345/81 |

FOREIGN PATENT DOCUMENTS

| | | | |
|---|---|---|---|
| EP | 1096466 | | 5/2001 |
| EP | 1640949 | A2 * | 3/2006 |
| JP | 2002-260851 | | 9/2002 |
| JP | 2004-101747 | | 4/2004 |
| JP | 2006120625 | A * | 5/2006 |
| WO | 2004/109641 | | 12/2004 |
| WO | 2005/015530 | | 2/2005 |

OTHER PUBLICATIONS

Inukai, K., "Late-News Paper: 4.0-in. TFT-OLED Displays & a Novel Digital Driving Method", SID 00 Digest, pp. 924-927, 36.4L.

* cited by examiner

DESIGN APPROACH AND PANEL AND ELECTRONIC DEVICE UTILIZING THE SAME

BACKGROUND

The disclosure relates to a design approach, and more particularly to a design approach for improving brightness emitted from light component sources on a panel.

FIG. 1 is a schematic diagram of a panel. Panel 1 comprises pixel units P11~Pmn arranged in an array and a white light source, such as white EL (Electroluminescent) device. Each pixel unit comprises three white light sub-pixels, and each sub-pixel comprises three primary color components that make up a resultant white light for each sub-pixel.

Taking pixel unit $P_{11}$ as an example, pixel unit $P_{11}$ comprises three white light sub-pixels $P_{11R}$, $P_{11G}$, $P_{11B}$, each make up of a combination of red, green, and blue colors. The resultant white light emission from each sub-pixel is filtered by a color filter, to render a color light to a viewer.

Pixel unit $P_{11}$ would be provided with a red color filter over the sub-pixel $P_{11R}$, a green color filter over the sub-pixel $P_{11G}$, and a blue color filter over the sub-pixel $P_{11B}$. The pixel unit $P_{11}$ can be controlled to produce a color image of a desired overall color, by controlling the relative intensity of the respective white sub-pixels, to produce color lights of the desired relative intensity as viewed through the corresponding color filters.

The intensity of the white EL devices often decreases significantly with operation due to the substantial property of three primary color components. The conventional method for compensating this shift in intensity utilizes photo sensors to detect the brightness of sub-pixels.

When a photo TFT detects the brightness of the blue light, the sensitivity of the photo TFT is higher. When the photo TFT detects the brightness of the red light or the green light, the sensitivity of the photo TFT is lower. Therefore, the conventional method does not appropriately to compensate the brightness of the red light and the green light as a photo TFT is utilized to detect the brightness.

SUMMARY

The present invention is directed to a novel design approach for a panel comprising a luminiferous unit and driving unit. The luminiferous unit comprises first and second color components respectively constituting a first and a second light component sources. First and second light components are respectively emitted from the first and the second light component sources. The color of the first light component differs from that of the second light component. First, a specific relationship of a characteristic between the first and the second color components is defined. The driving unit is designed according to the specific relationship.

Another design approach is also provided. The control method determines a change in emission of a desired light component out of several light components within a single color sub-pixel in an EL device. First, a relationship between changes in emissions of the several light components of the sub-pixel over a certain time period is predetermined. One of the several light components is designated a reference light component. Next, a change in emission of the reference light component in the sub-pixel is detected. Finally, a corresponding change in emission of the desired light component is determined and based on the predetermined relationship in reference to the detected emission of the reference light component.

An exemplary embodiment of a panel comprises a luminiferous unit and a driving unit. The luminiferous unit comprises a first color component constituting a first light component source and a second color component constituting a second light component source. A first and a second light components are emitted from the first and the second light component sources. The color of the first light component differs from that of the second light component. A specific relationship is gained according to a characteristic between the first and the second color components. The driving unit is designed according to the specific relationship for driving the luminiferous unit An exemplary embodiment of an electronic device comprises a panel, a data driver, and a scan driver. The panel comprises a luminiferous unit and a driving unit. The luminiferous unit comprises a first color component constituting a first light component source and a second color component constituting a second light component source. A first light component is emitted from the first light component source. A second light component is emitted from the second light component source. The color of the first light component differs from that of the second light component. A specific relationship is gained according to a characteristic between the first and the second color components. The driving unit is designed according to the specific relationship for driving the luminiferous unit. The data driver supplies data signals to the driving unit. The scan driver supplies data signals to the driving unit.

BRIEF DESCRIPTION OF THE DRAWINGS

The invention can be more fully understood by reading the subsequent detailed description and examples with reference made to the accompanying drawings, wherein.

DETAILED DESCRIPTION

Figure 1:
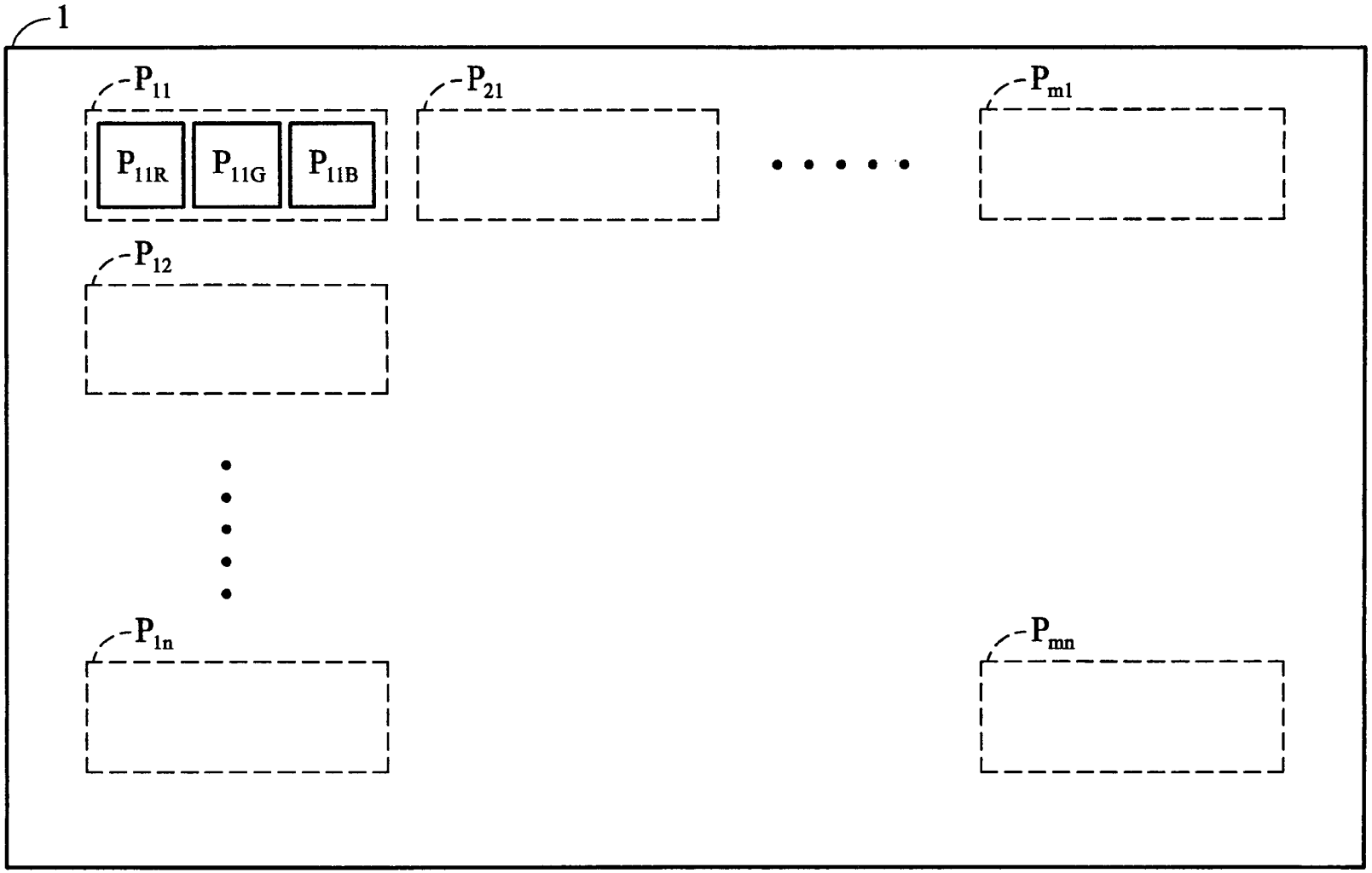
FIG. 1 ( RELATED ART )
FIG. 1 is a schematic diagram of a panel.
Figure 2:
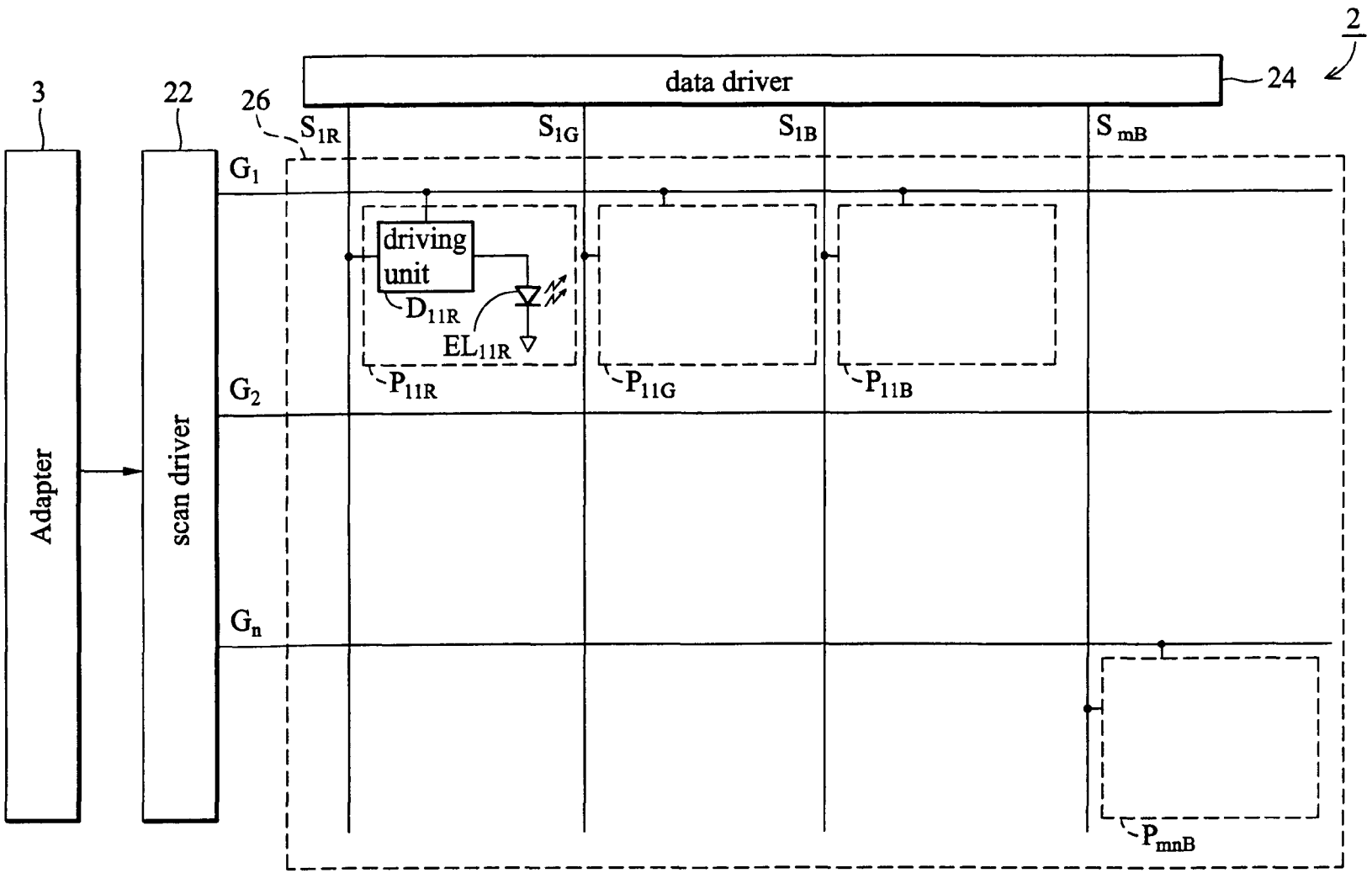
FIG. 2 is a schematic diagram of an embodiment of an electronic device.

FIG. 2 is a schematic diagram of an embodiment of an electronic device. An electronic device 2, such as a PDA, a display monitor, a notebook computer, a tablet computer, or a cellular phone, comprises an adapter 3 and a panel 26. Panel 26 is powered by power output from adapter 3. Electronic device 2 further comprises a scan driver 22 and a data driver 24.

Scan driver 22 supplies scan signals $G_1$~$G_n$ to gate electrodes. Data driver 24 supplies data signals $S_{1R}$~$S_{mB}$ to source electrodes. Panel 26 comprises sub-pixels $P_{11R}$~$P_{mnB}$, each comprising a driving unit and a luminiferous unit, such as an electroluminescent light device (ELD) comprising organic light emitting diode (OLED). The driving units are controlled by scan signals $G_1$~$G_n$ and data signals $S_{1R}$~$S_{mB}$. Therefore, each interlaced source electrode and gate electrode is used to control a sub-pixel.

For example, data signal $S_{1R}$ and scan signal G, control the sub-pixel $P_{11R}$ which comprises a driving unit $D_{11R}$ and a luminiferous unit $EL_{11R}$. Driving unit $D_{11R}$ drives luminiferous unit $EL_{11R}$ according to scan signal $G_1$ output from data driver 24 and data signal $S_{1R}$ output from scan driver 22. Additionally, driving unit $D_{11R}$ can detect and compensate for the brightness emitted from luminiferous unit $EL_{11R}$.

A white light emitted from luminiferous units on panel 26 is a composite of several light components. Each luminiferous unit in the panel 26 may have several different types of color components to emit different light components. In this embodiment, the white light emitted from panel 26 comprises a green light component, a blue light component, and a red light component. Additionally, the white light can be constituted by two light components, such as a blue light component and a red light component. Further, the composite light component emitted by the luminiferous units may be other than white. By using appropriate complementary color filters for sub-pixels, the desired resultant colors for the image can be obtained for each sub-pixel.

Since different color components have different aging characteristics, which results in different changes (e.g., decays) in brightness, voltage, or current characteristics, a specific relationship between different color components is predetermined according to the aging characteristics thereof. First, a detector (not shown) detects brightness emitted from panel 26 at a first and a second time. Then, a specific relationship is determined according to a ratio among the emission variable quantities of the red, the green, and the blue light components between the first and the second time. In other words, the specific relationship is the emission variable quantities of the red, the green, and the blue light components in a specific time range. A producer of electronic device 2 can design driving units $D_{11}$~$D_{mn}$ according to the specific relationship after the specific relationship has been determined.

Figure 3:
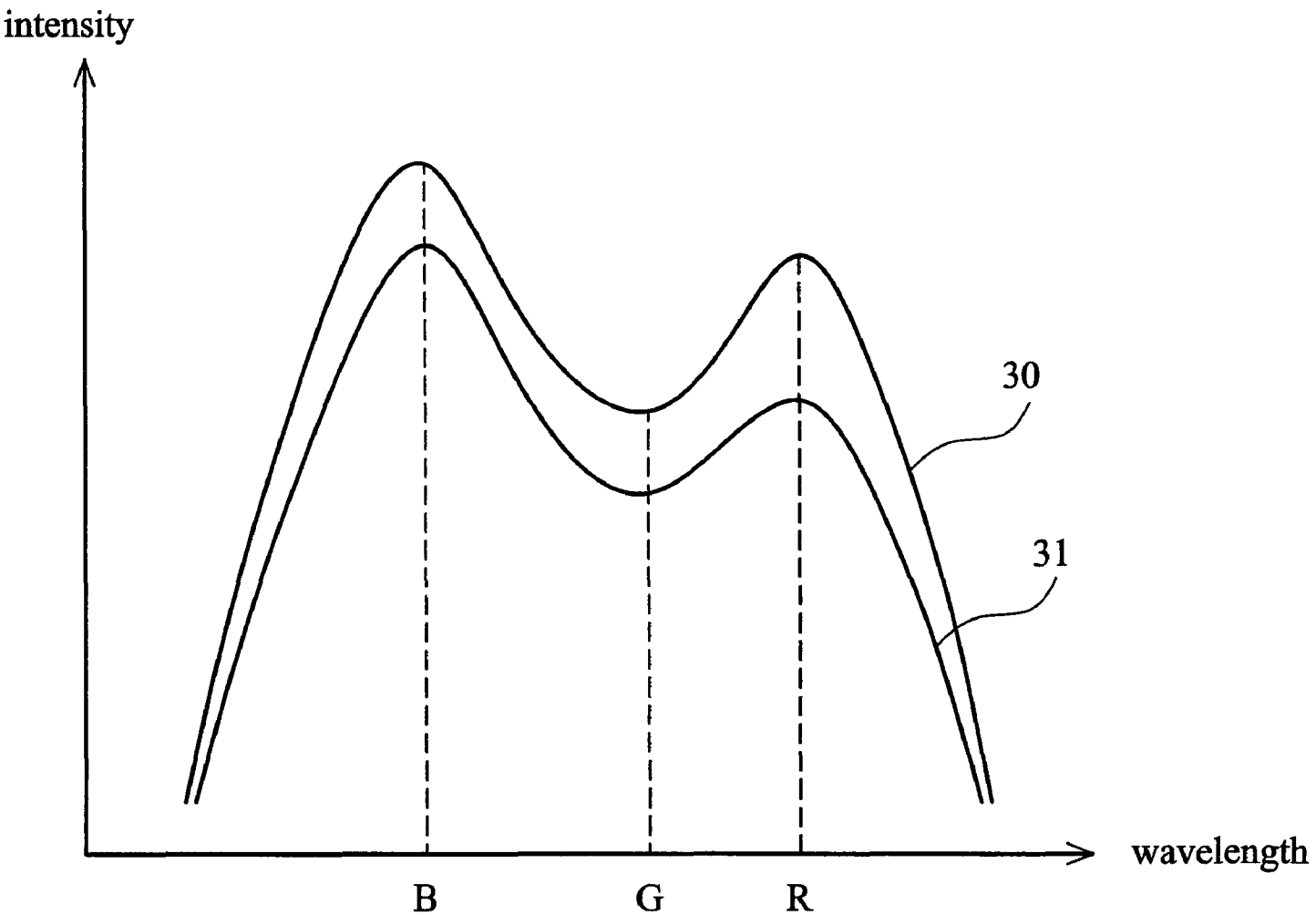
FIG. 3 shows a characteristic curve of the specific relationship.

FIG. 3 shows a characteristic curve of the specific relationship. Curve 30 indicates a relationship of the intensity and wavelength of various color components of the white light detected by a detector at time $t_0$. Curve 31 indicates a relationship of the intensity and wavelength of the white light detected by the detector at time $t_1$. Generally, intensity has a direct ratio to brightness. Label B indicates the wavelength of a blue light component. Label G indicates the wavelength of a green light component. Label R indicates the wavelength of a red light component.

As shown in FIG. 3, a relation between the wavelengths of the red and blue light components is $\Delta R = C1 \times \Delta B$. A relation between the wavelengths of the green and blue light components is $\Delta G = C2 \times \Delta B$. C1 and C2 are transformation parameters.

For example, if a ratio among the intensity decay quantities of the red, green, and blue light components is 2:(1.5):1 in the example shown in FIG. 3, when the intensity decay rate of the blue light component AB is 20%, the intensity decay rate of the red light component $\Delta R$ is $C1 \times \Delta B = 2 \times 20\% = 40\%$, and the intensity decay rate of the green light component $\Delta G$ is $C2 \times \Delta B = 1.5 \times 20\% = 30\%$.

Figure 4:
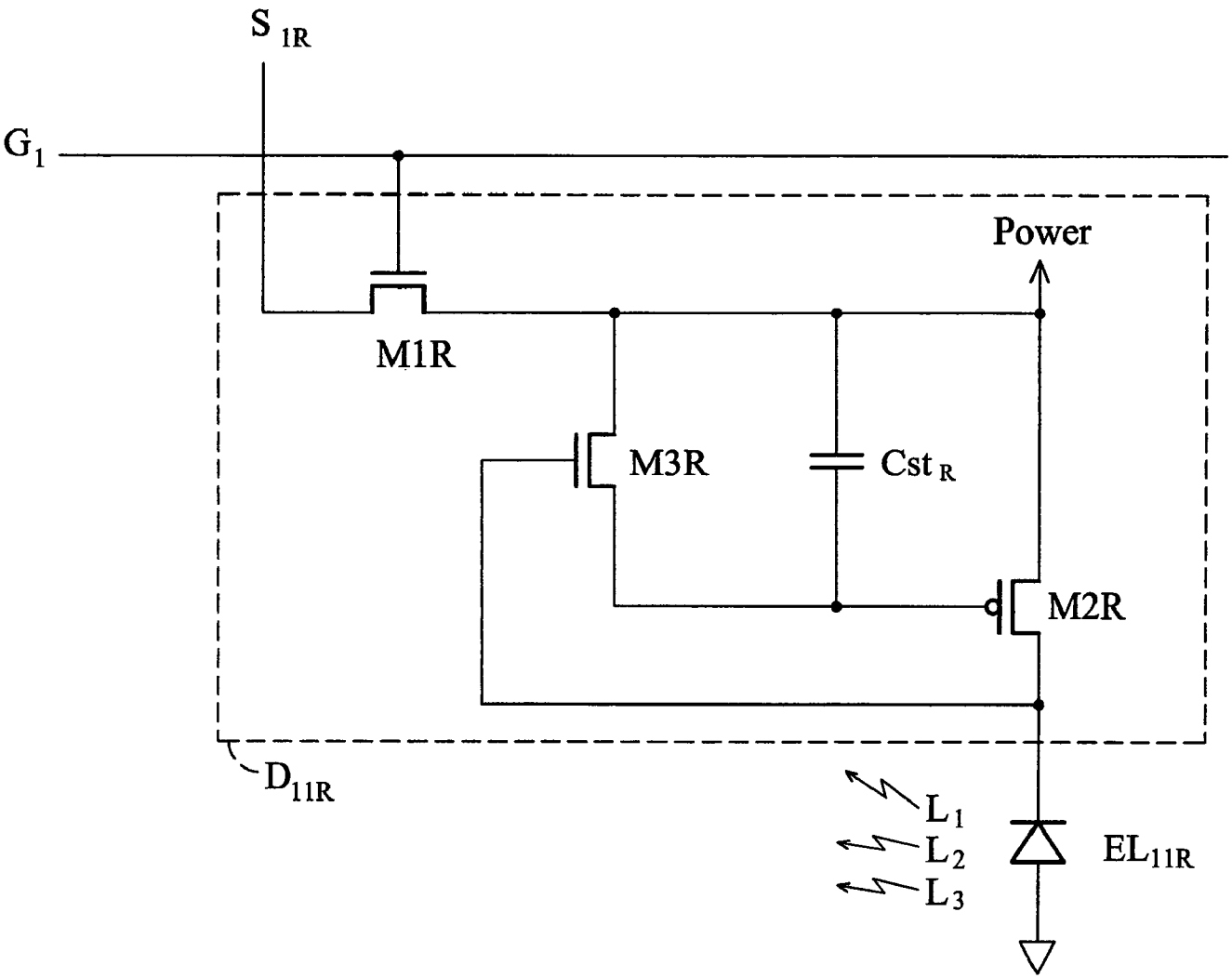
FIG. 4 is a schematic diagram of an embodiment of a sup-pixel.

FIG. 4 is a schematic diagram of an embodiment of a sup-pixel. A panel comprises a plurality of sub-pixels. FIG. 4 only shows a sub-pixel.

Since the drain and the source of a transistor are defined by current passing through the transistor, a source/drain and a drain/source respectively indicate two terminal of the transistor in the following.

Driving unit $D_{11R}$ comprises transistors M1R~M3R and capacitor $Cst_R$. The gate, or the control terminal, of the transistor M1R receives a scan signal $G_1$ in gate electrode and the drain/source thereof receives a data signal $S_{1R}$ in source electrode. The source/drain of the transistor M2R is coupled to a high voltage source Power and the drain/source thereof is coupled to luminiferous unit $EL_{11R}$. The gate of the transistor M3R is coupled to luminiferous unit $EL_{11R}$, the drain/source thereof is coupled to the source/drain of the transistor M1R and the high voltage source Power, and the source/drain thereof is coupled to the gate of the transistor M2R. Capacitor $Cst_R$ is coupled between the source/drain and the gate of the transistor M2R.

As shown in FIG. 4, when a scan driver outputs a scan signal $G_1$ to gate electrode, the transistor M1R receives a data signal $S_{1R}$ from source electrode for charging capacitor $Cst_R$. Luminiferous unit $EL_{11R}$ emits a white light as transistor M2R is turned on by capacitor $Cst_R$. The white light is constituted by a red light component $L_1$, a green light component $L_2$, and a blue light component $L_3$.

Transistor M3R can be formed by a low temperature poly silicon (LTPS) or amorphous silicon technology. Transistor M3R can be a photo diode or a photo transistor to detect and compensate for the brightness emitted from luminiferous unit $EL_{11R}$. In this embodiment, transistor M3R is a photo transistor for detecting the blue light component within the white light emitted from luminiferous unit $EL_{11R}$, as a reference color component.

By designing the driving unit $D_{11R}$ according to the specific relationship, the brightness decay effect of luminiferous unit $EL_{11R}$ due to the aging relationship of the color components is decreased. In this embodiment, the size of transistor M3R is defined for compensating the red color component based on the reference blue color component and the specific relationship. For example, the size is a ratio between a length and a width of a channel of transistor M3R. Additionally, capacitance of capacitor $Cst_R$ can be also defined by the specific relationship.

While a panel comprises many sub-pixels, only a portion of the sub-pixels will frequently be utilized, such that the brightness emitted from the frequently utilized sub-pixels will decay. Therefore, driving units must have detection and compensation functions. Taking sub-pixel $P_{11R}$ as an example, the driving unit $D_{11R}$ can be designed to change a current passing through luminiferous unit $EL_{11R}$ or luminiferous time of luminiferous unit $EL_{11R}$ to compensate for the brightness emitted from luminiferous unit $EL_{11R}$.

In this embodiment, transistor M3R detects and compensates for the brightness emitted from luminiferous unit $EL_{11R}$. Transistor M3R controls a discharge time of capacitor $Cst_R$ according to the brightness emitted from luminiferous unit $EL_{11R}$. When the discharge time is slower, the enabling status time of transistor M2R is longer.

The above compensation circuit could be provided in all the sub-pixels in a similar fashion, for compensating a desired light component in each sub-pixel, based on a reference light component detected in the sub-pixel, and the predetermined relationship.

Figure 5A:
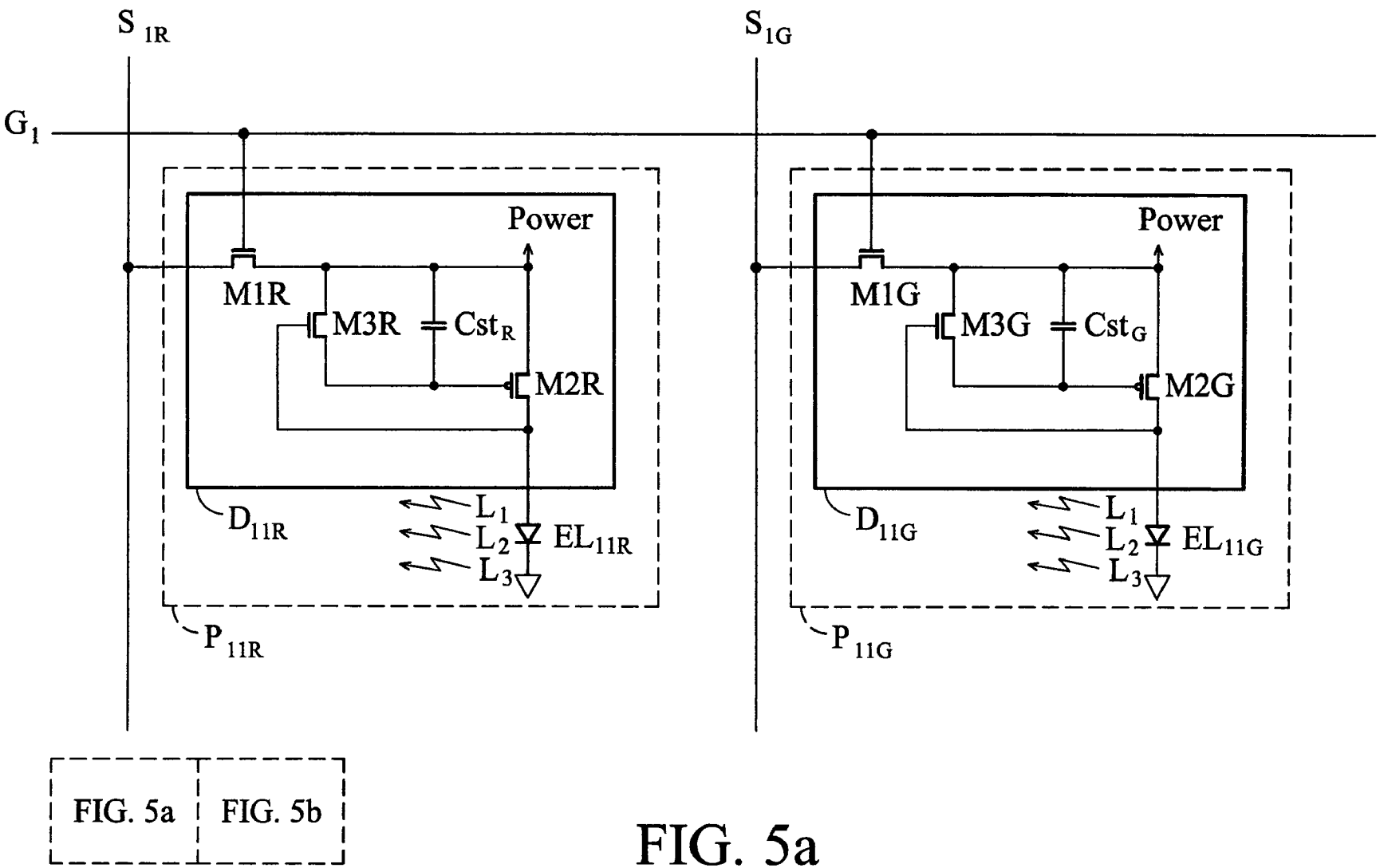
FIGS. 5*a* and 5*b* are schematic diagrams of a pixel unit.
Figure 5B:
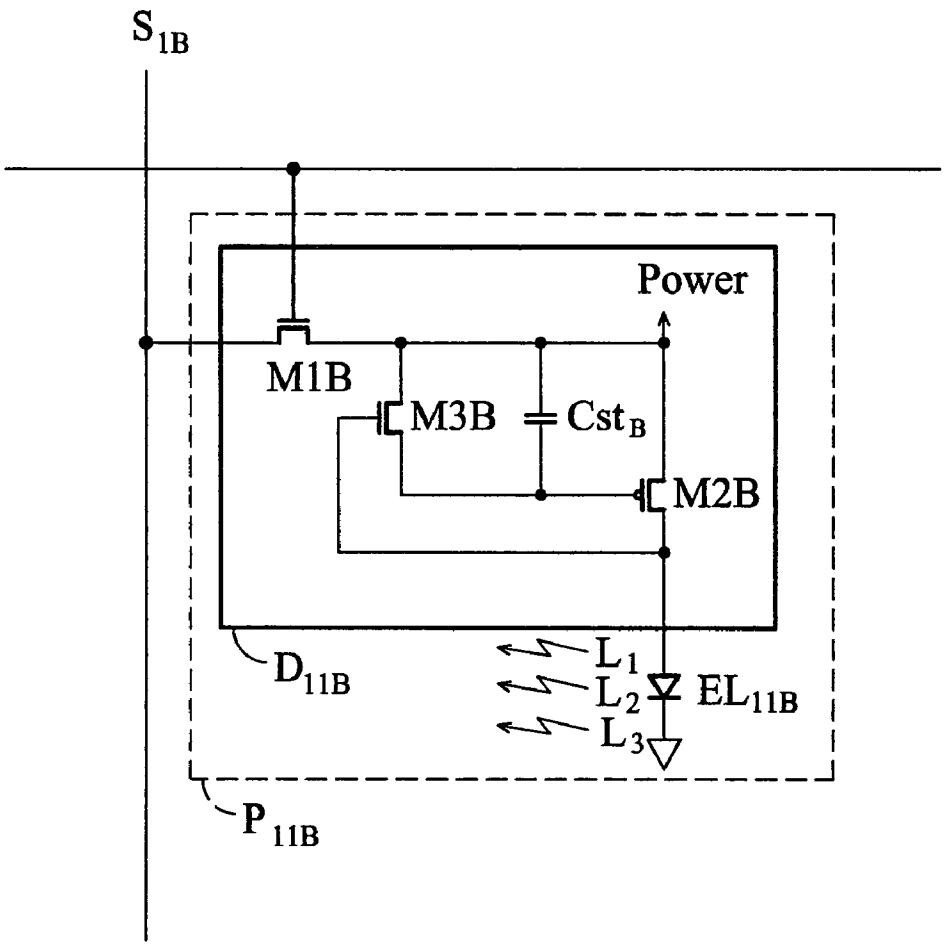

FIGS. 5*a* and 5*b* are schematic diagrams of three sub-pixels. Sub-pixels $P_{11R}$, $P_{11G}$, $P_{11B}$ respectively display a red light component, a green light component, and a blue light component. Driving units $D_{11R}$, $D_{11G}$, $D_{11B}$ respectively drive luminiferous units $EL_{11R}$, $EL_{11G}$, $EL_{11B}$ to emit a white light according to data signals $S_{11R}$, $S_{11G}$, $S_{11B}$ output from source electrodes.

Although luminiferous units $EL_{11R}$, $EL_{11G}$, $EL_{11B}$ respectively emit a white light, color filters can be utilized to render a required light component from a white light such that sub-pixels $P_{11R}$, $P_{11G}$, $P_{11B}$ display the required light component. For example, if sub-pixel $P_{11R}$ desires to display a red light, a red color filter is utilized for filtering the red light from a white light emitted from luminiferous unit $EL_{11R}$.

Since the intensity decay rate among the red, green, and blue light components of white light is effected by aging characteristics of color components, transistors M3R, M3G, M3B are respectively utilized to change the discharge time of capacitor $Cst_R$, $Cst_G$, $Cst_B$ for compensating brightness of the respective red, green, and blue light components in the respective sub-pixels. Taking sub-pixel $P_{11R}$ as an example, when the channel size of transistor M3R is greater, the discharge time of capacitor $Cst_R$ is shorter, such that the luminiferous time of luminiferous unit $EL_{11R}$ is shorter. As such, the structures of the compensating driving components (i.e., M3R, M3G and M3B in the illustrated embodiment) between different color sub-pixels would be different, because of the different characteristics of decay in brightness for the different color components that are being compensated in the different color sub-pixels. Therefore, if the intensity decay rate among the red, green, and blue light components constituting white light within a sub-pixel is 2:(1.5):1, the relative channel size ratio among transistors M3R, M3G, M3B is 1:(1.5):2.

The brightness of white lights emitted from luminiferous units $EL_{11R}$, $EL_{11G}$, $EL_{11B}$ are defined by data signals $S_{11R}$, $S_{11G}$, $S_{11B}$ from source electrodes. The brightness of white lights emitted from luminiferous units $EL_{11R}$, $EL_{11G}$, $EL_{11B}$ may be 200 nits for example. When the emission of a white light emitted from luminiferous unit $EL_{11R}$ decays to 100 nits, the emission of red light component $L_1$, the emission of green light component $L_2$, and the emission of blue light component $L_3$ forming the brightness of the white light are decayed.

When the decay quantity of the blue light component of the white lights is detected by transistor M3R, transistor M3R will decrease the discharge time of capacitor $Cst_R$ to increase the turn time of transistor M2R such that luminiferous times of the white lights are increased to compensate for the emission of the white light emitted from luminiferous unit $EL_{11R}$.

Figure 6A:
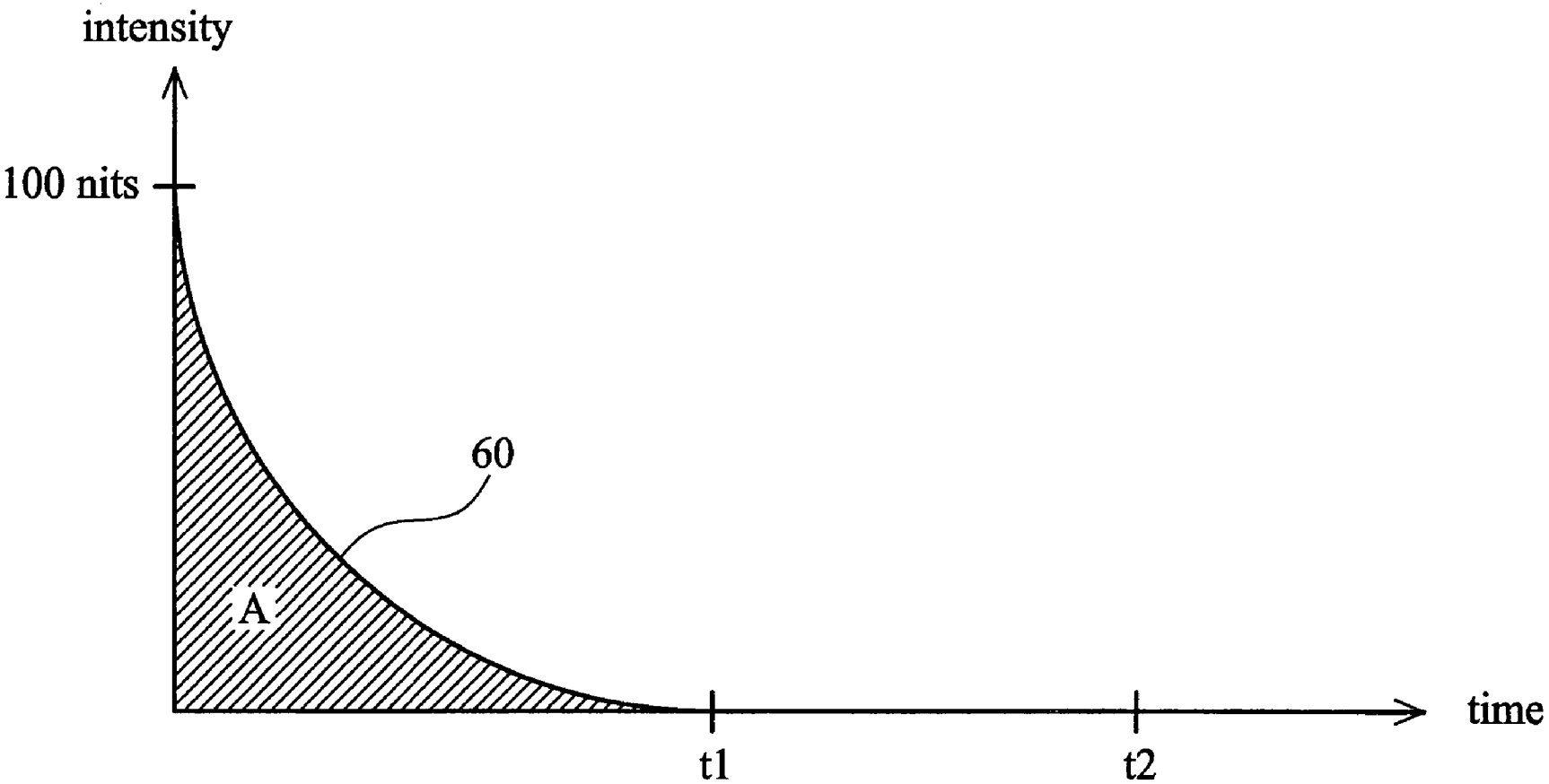
FIGS. 6*a* and 6*b* show characteristic curves of a luminiferous unit, comprising time and brightness.
Figure 6B:
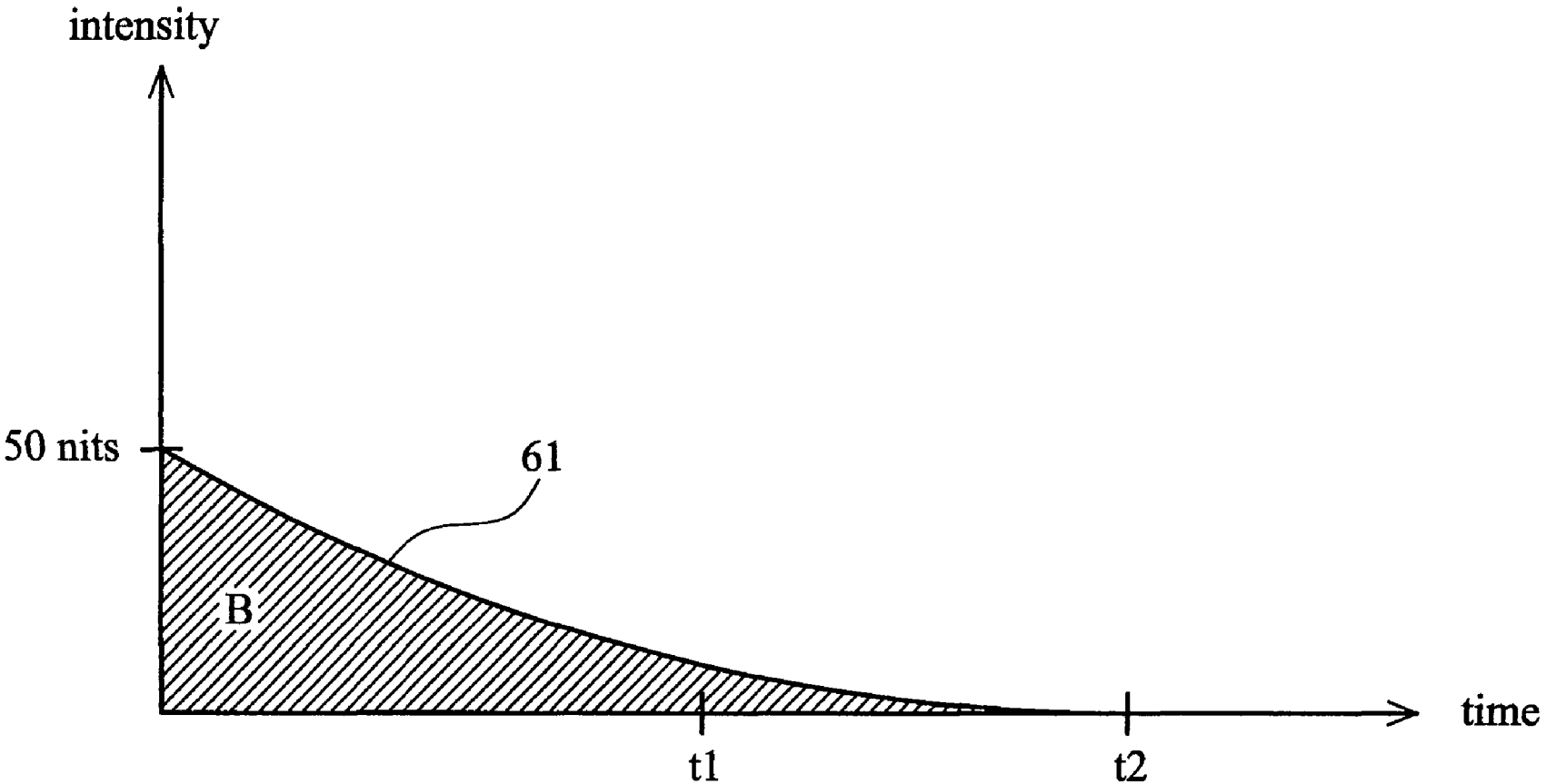

FIGS. 6*a* and 6*b* show characteristic curves of a luminiferous unit, comprising time and brightness. Curve 60 indicates a normal brightness emitted from the luminiferous unit. Curve 61 indicates a compensated brightness emitted from the luminiferous unit. Compare FIG. 6*a* with FIG. 6*b*, the maximum brightness in FIG. 6*a* exceeds that in FIG. 6*b* but the luminiferous time in FIG. 6*a* is less than that in FIG. 6*b*. Therefore, region A is equal to region B such that the efficiency of the normal brightness equals the compensated brightness.

Figure 7:
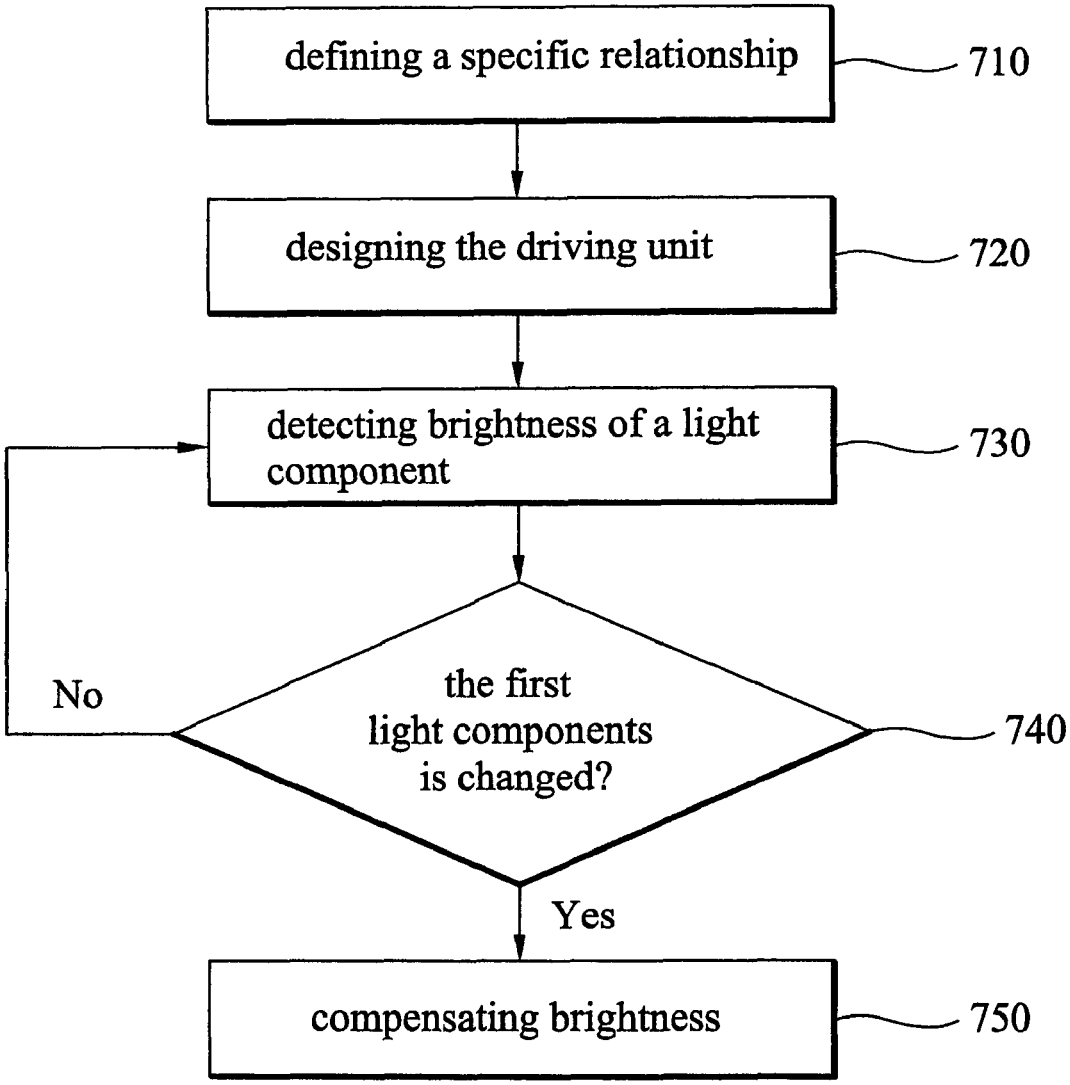
FIG. 7 is a flowchart of the design approach of a panel.

FIG. 7 is a flowchart of an embodiment of a design approach. The design approach is applied to a panel comprising a luminiferous unit and a driving unit. The luminiferous unit comprises first and second color components respectively constituting a first and a second light component sources. A first and a second light components are respectively emitted from the first and the second light component sources. The color of the first light component differs from that of the second light component.

First, a specific relationship is predetermined according to a characteristic between the first and the second color components in step 710. Since each color component has an aging characteristic, the brightness of a first and a second light components will decay within a specific time range. The first and the second light component sources are constituted by different color components, the brightness variable quantity of the first light component differs that of the second light component within the specific time range. The specific time range is between a first time and a second time more than the first time. The specific relationship is a ratio between the brightness variable quantities of the first and the second light components.

Since each color components has the aging characteristic and the second time exceeds the first time, the brightness of the first and the second light components detected in the second time are darker than that detected in the first time.

The driving unit is designed according to the specific relationship in step 720. Since the aging characteristics of color components will affect the brightness of the first and the second light components, when the driving unit is designed according to the specific relationship, the brightness of the first and the second light components can be compensated.

As shown in FIG. 5, size of transistors M1R~M3R, M1G~M3G, M1B~M3B, or capacitance of capacitor $Cst_R$, $Cst_G$, $Cst_B$ can be changed for compensating aging characteristics of the first and the second color components. In this embodiment, the channel size of transistor M3R, M3B, M3G are changed. If the aging speed of color component is faster, the channel size of the transistor is smaller.

When the driving unit is designed according to the specific relationship, the effect of brightness decay due to the aging characteristic of the color component can be reduced.

The brightness of the first light component is detected in step 730 and then the brightness of the first light component is determined in step 740. If emission of the first light component is changed, one of emissions of the first and the second light components is compensated in step 750. If emission of the first light component is unchangeable, no compensation is needed. The detection of the emissions of the first light component is repeated in step 730, to continuously monitor decay in the emission.

Additionally, the first and the second light component sources constitute an electroluminescent light device (ELD). Therefore, a current passing through the ELD or the luminiferous time of the first light component can be changed for compensating the emission of the first light component.

In summary, since the driving unit is designed according to a specific relationship between color components, brightness decay due to the color components can be reduced.

Additionally, when the brightness emitted from one luminiferous unit decays, the driving unit can compensate for the brightness emitted from the luminiferous unit. Since photo sensors of the driving units detect the same color light, complexity of elements can be reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of designing a panel comprising a luminiferous unit and a driving unit, wherein the luminiferous unit comprises a first and a second light components respectively constituting a first and a second light component sources, a first and a second light components are respectively emitted from the first and the second light component sources, and the color of the first light component differs from that of the second light component, the method comprising:

defining a specific relationship of a characteristic between the first and the second color components; and designing the driving unit according to the specific relationship, wherein channel size of a transistor of the driving unit is designed by the specific relationship;

detecting a change in emission of the first light component; and compensating one of emissions of the first and the second light components based on the specific relationship and the detected emission of the first light component.

2. The method as claimed in claim 1, wherein one of luminiferous times of the first and the second light components are changed according to the specific relationship and the detected emission of the first light component.

3. The method as claimed in claim 1, wherein an electroluminescent light diode (ELD) is formed by the first and the second light component sources.

4. The method as claimed in claim 3, wherein a current passing through the ELD is changed according to the specific relationship and the detected emission of the first light component.

5. The method as claimed in claim 1, wherein designing the driving unit comprises determining a channel size of a transistor of the driving unit.

6. The method as claimed in claim 1, wherein designing the driving unit comprises determining a capacitor of the driving unit.

7. The method as claimed in claim 1, wherein the change in emission of the first light component is detected optically.

8. The method as claimed in claim 1, wherein the specific relationship is defined based on changes in emissions of the first and second color components over a certain time period.

9. A method of determining a change in emission of a desired light component out of several color components within a single color sub-pixel in an EL device, comprising:

predetermining a relationship between changes in emissions of the several color components over a certain time period, one of the several color components is designated a reference color component;

optically detecting a change in emission of the reference color component in the sub-pixel;

determining a corresponding change in emission of the desired color component, based on the predetermined relationship in reference to the detected emission of the reference color component; and compensating one of the emissions of the color components based on the predetermined relationship and the optically detected emission of the reference color component.

10. A panel comprising:

a luminiferous unit comprising a first color component constituting a first light component source and a second color component constituting a second light component source, wherein a first and a second light components are emitted from the first and the second light component sources, and the color of the first light component differs from that of the second light component and a specific relationship is predetermined according to a characteristic between the first and the second color components;

a driving unit designed according to the specific relationship for driving the luminiferous unit, wherein one of the first and the second light components is a reference light component, wherein channel size of a transistor of the driving unit is designed by the specific relationship, and wherein the driving unit comprises a drive circuit structured to detect a change in emission of the reference light component, and to adjust emission of a desired light component corresponding to the detected change in emission of the reference light component and in accordance with the predetermined relationship between changes in emissions of the several light components over a certain time period.

11. The panel as claimed in claim 10, wherein the drive circuit comprises a sensing device detecting a change in emission of the reference light component.

12. The panel as claimed in claim 11, wherein the sensing device is structured in accordance with the predetermined relationship to provide adjustment to the emission of the desired light component based on the detected change in emission of the reference light component.

13. The panel as claimed in claim 10, wherein the capacitance of a capacitor of the driving unit is designed by the specific relationship.

14. An electronic device, comprising:

an adapter outputting power; and a panel as claimed in claim 10, wherein the panel is powered by the adapter.

15. The electronic device as claimed in claim 14, further comprising:

a scan driver supplying a plurality of scan signals for enabling the driving unit; and a data driver supplying a plurality of data signals to the driving unit.

16. The electronic device as claimed in claim 14, wherein the electronic device is at least one of a PDA, a display monitor, a notebook computer, a tablet computer, or a cellular phone.

17. The method as claimed in claim 10, wherein the change in emission of the reference light component is detected optically.

* * * * *